United States Patent [19]

Jundanian et al.

[11] Patent Number: 4,956,640

[45] Date of Patent: Sep. 11, 1990

[54] METHOD AND APPARATUS FOR CONTROLLING VIDEO DISPLAY PRIORITY

[75] Inventors: Richard H. Jundanian; David C. Hempstead, both of Methuen, Mass.

[73] Assignee: Hewlett-Packard Company, Palo Alto, Calif.

[21] Appl. No.: 276,972

[22] Filed: Nov. 28, 1988

[51] Int. Cl.[5] ..... G09G 1/02

[52] U.S. Cl. ..... 340/799; 340/798

[58] Field of Search ..... 340/799, 798, 703

[56] References Cited

U.S. PATENT DOCUMENTS

| | | | |
|---|---|---|---|
| 4,509,045 | 4/1985 | Mossaides | 340/703 |
| 4,562,435 | 12/1985 | McDonough et al. | 340/798 |
| 4,691,295 | 9/1987 | Erwin et al. | 340/798 |
| 4,745,407 | 5/1988 | Costello | 340/799 |
| 4,773,026 | 9/1988 | Takahara et al. | 340/799 |
| 4,782,462 | 11/1988 | Kaplinsky et al. | 340/799 |

*Primary Examiner*—Jeffery A. Brier

*Attorney, Agent, or Firm*—Frank R. Perillo

[57] ABSTRACT

This invention provides a method and apparatus for controlling the type of information displayed at each display pixel on the video monitor of a video display system. A number of video RAMs are provided which number is at least equal to the number of different types of information. A bitmap is stored for each type of information in the video RAMs in interspersed fashion, a selected number of bits for select display pixels of the bitmap for a given type of information being simultaneously stored in said RAMs, followed for each RAM by the selected number of bits for the same selected display pixels for the bitmap of at least one other information type. No more than one bitmap bit for a given display pixel is stored in any video RAM. The addressing of the RAMs for read out of the bitmap is shifted so that bits for the same display pixels for all of the bitmaps are simultaneously read out from the RAMs. The bits of the bitmaps for each display pixel are then prioritized, the prioritizing including determining and generating an indication of the type of information which has priorty and is to be displayed at each display pixel.

12 Claims, 6 Drawing Sheets

METHOD AND APPARATUS FOR CONTROLLING VIDEO DISPLAY PRIORITY

FIELD OF THE INVENTION

This invention relates to a method and apparatus for controlling a video display and more particularly to a method and apparatus for controlling which one of a number of different types of information, each of which has a different priority, is displayed at each display pixel of a video monitor.

BACKGROUND OF THE INVENTION

In many video systems, various types of information, either from different sources or from the same source, are available for display on a display monitor. Such types of information may for example be graphics, alphanumerics, cursors or other control indications on the screen, or light or dark background areas for one of the above. An example of an application where such various types of information arise is where graphic information is being displayed and it is desired to provide an alphanumeric "window" over the qraphic display. In this application, a blanking of the window area might occur to provide a light background on which the alphanumerics are easily viewed, the alphanumerics possibly being obscured by portions of the graphics if both had the same or substantially similar gray scale values. Another example might be in industrial design or architectural applications where different sections are stored of a product or structure with it being possible to select material from different layers for simultaneous display.

In applications such as those described above, it is necessary to establish a priority among the various types of the information and to determine the highest priority type of information which is to be displayed at a given pixel position of the display during each display refresh cycle. One way in which this prioritization may be accomplished is to provide a memory plane bitmap for each type or level of information which is adapted to be displayed. When, either in response to a user input, to a processor output, or to some combination thereof, an indication is received that information of a particular type or level is to be displayed in a particular pixel position or area of the display, the bitmap plane for that level has bits written into it for the appropriate pixel positions. A mechanism may then be provided for determining the memory plane or bitmap having the highest priority (or at the highest level) which has a bit stored in it for each pixel position of the display an this determination is utilized to control the type of information which is displayed at each such pixel position.

Heretofore, performing the prioritization function indicated above has been relatively time consuming for a number of reasons. First, the video RAMs which are frequently utilized for performing such function are adapted to store and to read out only four bits at a time. Thus, for high resolution displays which may, for example, have 512×512 pixels, 1024×1024 pixels, or more, a very large number of read-out cycles from each of the priority bitmap memories is required in order to obtain a single bitmap and a large number of write cycles may be required to store a bitmap. Secondly, buffering and masking may be required in order to assure that comparable information from each of the bitmap planes is being simultaneously accessed so that meaningful comparisons can be made in the prioritizing circuitry.

An improved method and apparatus for performing the prioritization function in a video display system is therefore required which system permits information concerning a given information level or type to be stored as a bitmap as quickly as possible and which permits information for the various bitmaps which are to be compared to be simultaneously read out and utilized for the priority determination.

SUMMARY OF THE INVENTION

In accordance with the above, this invention provides a method and apparatus for controlling the type of information displayed at each display pixel on the video monitor of a video display system. A number of video RAMs are provided which number is at least equal to the number of different types of information. A bitmap is stored for each type of information in the video RAMs in interspersed fashion, a selected number of bits for selected display pixels of the bitmap for a given type of information being simultaneously stored in said RAMs, followed for each RAM by the selected number of bits for the same selected display pixels for the bitmap of at least one other information type. No more than one bitmap bit for a given display pixel is stored in any video RAM. The addressing of the RAMs for read out of the bitmaps is shifted so that bits for the same display pixels of all the bitmaps are simultaneously read out from the RAMs. The bits of the bitmaps for each display pixel are then prioritized, the prioritizing including determining and generating an indication of the type of information which has priority and is to be displayed at the display pixel. During the prioritizing operation, the bitmap which each set of bits from the RAMs relate to are recognized. For the preferred embodiment, this recognizing is accomplished by generating time signals and indicating, in response to the state of the timing signals, the bitmap to which a bit received from a given RAM relates.

The foregoing and other objects, features and advantages of the invention will be apparent from the following more particular description of a preferred embodiment of the invention as illustrated in the accompanying drawings.

IN THE DRAWINGS

DETAILED DESCRIPTION

Figure 1:
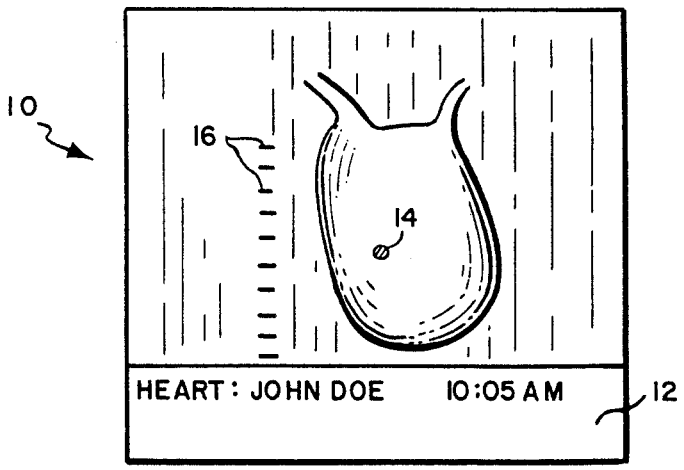
FIG. 1 is a diagram illustrating a video display with at least four different types of information simultaneously appearing on the screen.

FIG. 1 is a diagram illustrating the environment in which the teachings of this invention might be utilized. Referring to FIG. 1, the screen 10 of a CRT monitor is shown for an illustrative application, such as medical imaging, where various types of information are being simultaneous displayed. In FIG. 1, there is graphic information which may for example be an image of the heart and possibly other organs of a patient. A second type of information is represented by a blank or light background area or window 12 on which various alphanumeric information (a third type of information) concerning the display is to be presented. Illustrative alphanumeric information is shown in area 12. Finally, a cursor 14 and various measurement grid markings 16 appear in the qraphic area, these representing a fourth type of information.

In order to assure the visibility of desired information of a given type, priority levels must be assigned. For purposes of illustration, in the following discussion it will be assumed that the highest priority is assigned to cursor 14 and measurement grids 16; that the next highest level of priority is assigned to the alphanumeric information in area or window 12 (wherever that area may be positioned on display 10); the third level of priority is assigned to the blanking area 12; and the fourth or lowest level of priority is assigned to the graphics information. It will be further assumed that the display 10 has a number of individual display pixels each of which may assume a plurality of different gray scale levels, the pixels being combined to form the desired image or images. The display may thus, for example, be formed of a raster of 512×512 pixels. For each of these pixel positions, a decision must be made as to the type of information which will be displayed at that pixel, the information displayed being the information for the highest priority information available for display at that pixel location. Thus, if in area 12 there was graphic information available for display but a request had been made to generate an alphanumeric window in this area, the blankinq signal would have priority over the qraphic information. Similarly, if alphanumeric information existed for display at the particular pixel location, such information would take priority over the blanking information.

Figure 2:
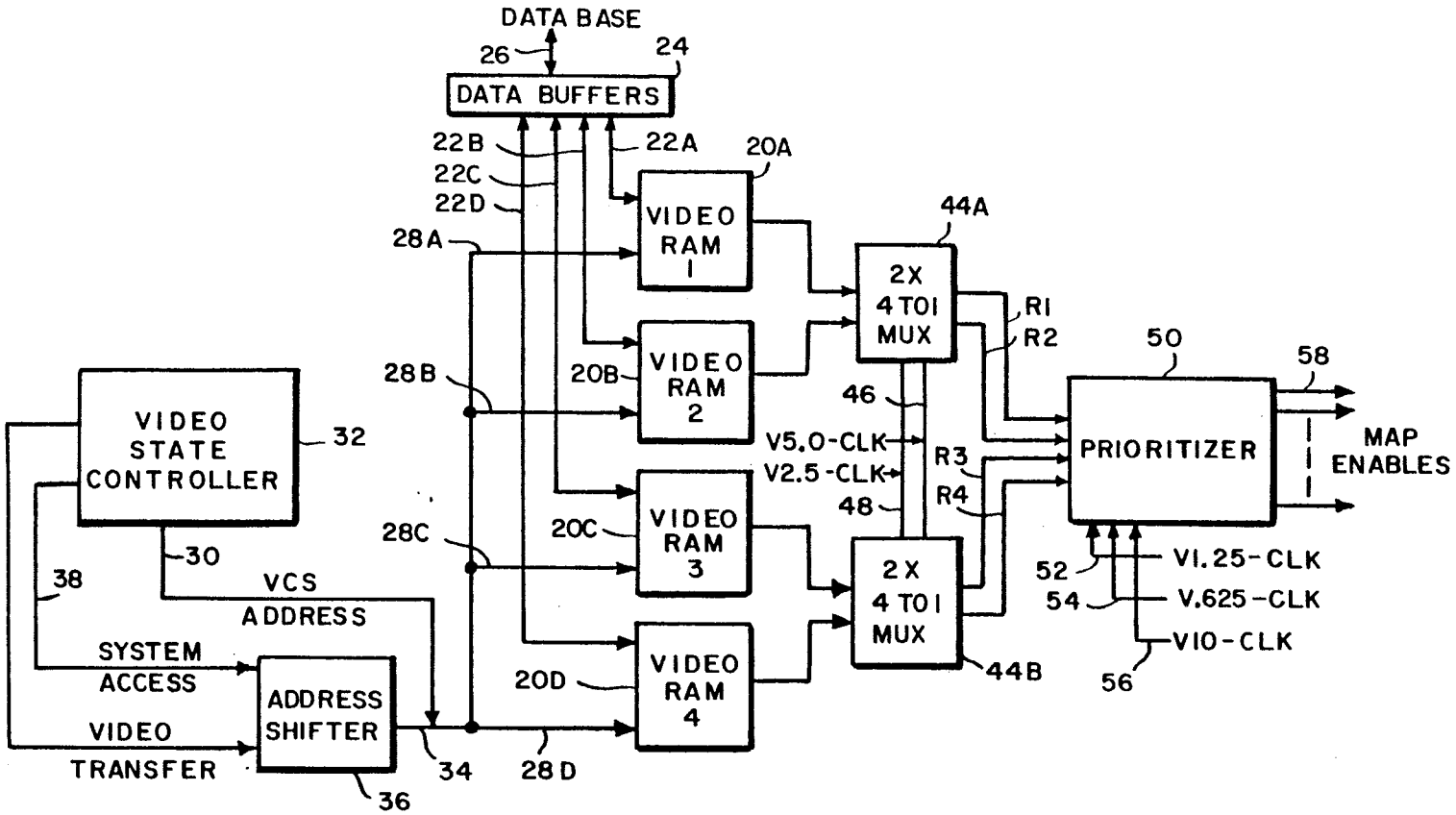
FIG. 2 is a schematic block diagram of a circuit adapted to practice the teachings of this invention.

FIG. 2 is a schematic diagram of a circuit suitable for controlling the information displayed on screen 10 utilizing the teachings of this invention. In this circuit, it is assumed that there are the four priority levels described above with respect to FIG. 1. Four video random access memories (video RAMs) 20 are provided, each of which has at least a bit position corresponding to each display pixel of the CRT monitor 10 in FIG. 1. Thus, if display 10 had a 512×512 raster, each video RAM 20 would have a capacity for storing at least 512×512 bits.

Data is loaded into the video RAMs in four bit nibbles or bytes over lines 22 from data buffers 24. Buffers 24 receive data inputs over a data bus 26 from a control processor (not shown) or other suitable data source.

The address at which each nibble of bits on lines 22 are stored is determined by signals on address lines 28 for each RAM 20. While eight address lines are applied as the input to each video RAM, these are not the same eight lines for each RAM. Each of the address lines 28 includes the six video control state (VCS) address lines 30 from video state controller 32 and a selected two of the eight output lines 34 from address shifter circuit 36. Address shifter 36 receives address inputs over lines 38 and certain control inputs over lines 40. The manner in which the RAMs are addressed for read in will be discussed in detail later.

Since video RAMs are dual ported devices, at the same time the information is being read into these memories, information may be read out. However, to avoid any potential conflict, it is preferable that read-in not occur when a read-out cycle is being performed; but, since read-out occurs during only a small portion of the total system cycle, even with this restriction, the video RAMs should be available for read in roughly 90% of the time.

For reading out information from video RAMs 20, the video RAMs are addressed in a manner to be described hereinafter to cause a selected four bit nibble to be read out from each of the RAMs 20 into a corresponding four bit multiplexer 44. The multiplexers are then clocked out under control of clock signals on lines 46 and 48 to cause the corresponding bit of each bitmap for a given display pixel to be simultaneously applied over a line R to prioritizer 50. Prioritizer 50 may for example be a programmed array which, in response to the inputs on lines R1– R4, and to clock signals on lines 52, 54 and 56 generates an output on a selected one of the map enable lines 58 to cause the appropriate information from a frame buffer or other information source to be applied to control the display at the selected display pixel.

Figure 3:
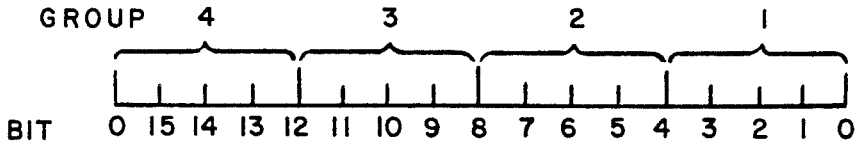
FIG. 3 is a diagram illustrating how bits are grouped into nibbles in the video RAMs of FIG. 2.

The key to the operation of the circuit shown in FIG. 2 is the manner in which information is read into and read out of video RAMs 20. FIG. 3 shows the manner in which each sixteen bit word, which contains sixteen bits of the bitmap for a given type of information, is divided into four groups or nibbles. Since information is transferred into and out of the video RAMs four bits at a time, for ease of illustration these read/write operations will be illustrated on a group or nibble basis rather than on a bit basis.

Figure 4A:
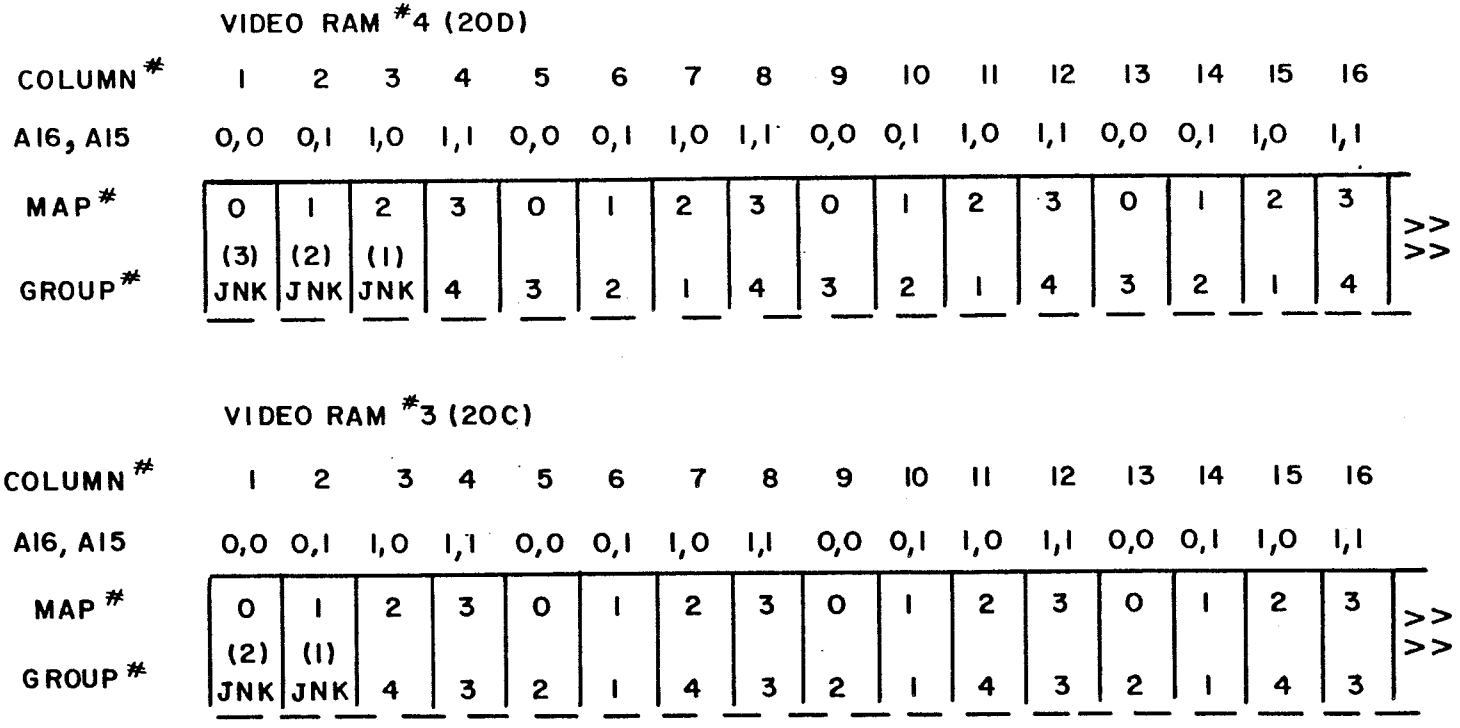
FIG. 4 is a diagram illustrating the manner in which bitmap information is read into the video RAMs of FIG. 2.
Figure 4B:
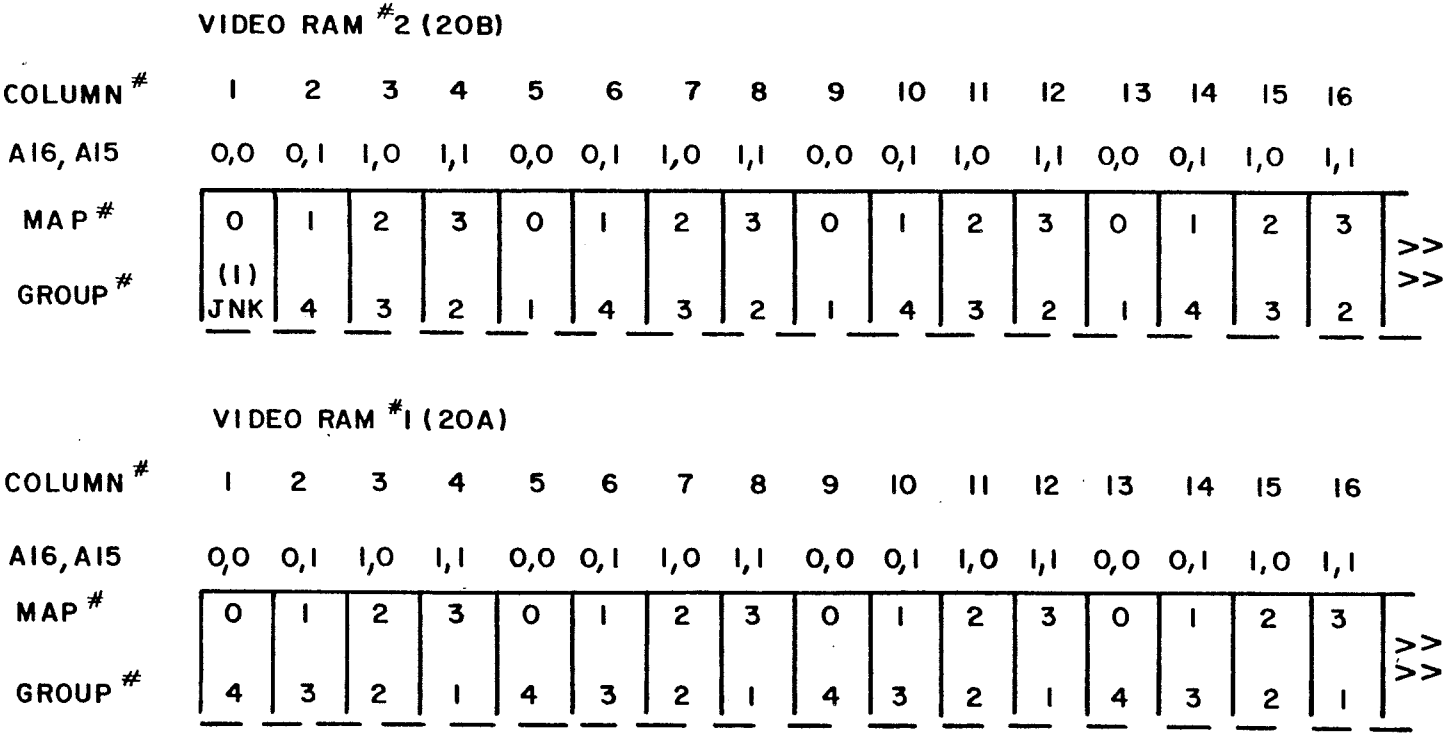

FIG. 4 illustrates the way in which information is stored in the four video RAMs 20A–20D. In this figure, the map number refers to one of the four bitmaps, map 0 for example being the highest priority bitmap for cursor 14, measurement lines 16 and the like; bitmap 1 being the next highest priority bitmap which is for alphanumeric information; bitmap 2 being the next higher priority information which is for blankinq signals such as those to generate the window 12; and bitmap 3 being for the lowest priority graphic information. Within each RAM, information is received a nibble at a time with the group number for each nibble being indicated. The column numbers merely indicate successive time periods, while the state of the A15 and A16 bits refer to the state of the two address bits from address shifter 36 which are applied to each of the video RAMs.

Thus, at time period or column 1, the address inputs on the lines 15 and 16 to all four of the video RAMs is 00 and information for bitmap 0 is being applied to all of the video RAMs. The group applied to the video RAM 1 during this write cycle is group four (i.e., the last four bits) of a given video word. For reasons which will become apparent when the read out operation is discussed, either nothing or junk information is stored in video RAMs 2, 3 and 4 (20B, 20C, and 20D respectively) during this time interval.

During the second time interval the A15 and A16 bits for all of the video RAMs are set to 1 and 0 respectively, and nibbles for bitmap 1 are simultaneously stored in all of the RAMs. In this case group 3 and group 4 for the first word of the bitmap are stored in the appropriate address positions of video RAMs 1 and 2 respectively and junk is still stored in video RAMs 3 and 4.

During the third time interval, bits 15 and 16 for all of the video RAMs are set to 0 and 1 respectively and a nibble for bitmap 2 is read into each of the RAMs. In this case, nibbles 2, 3 and 4 respectively are written into video RAMs 1, 2 and 3, while junk is still read into video RAM 4.

During the fourth time interval bits A15 and A16 are both set to 1 for all of the video RAMs and a word for bitmap 3 is read into the video RAMs with nibble 1 of the word being read into video RAM 1, nibble 2 of the word being read into video RAM 2, nibble 3 of the word being read into video RAM 3, and nibble 4 of the word being read into video RAM 4. During the 5th, 6th, 7th and 8th time intervals the settings of the A15 and A16 bits are the same as they were for time periods 1, 2, 3 and 4 respectively and the map for which a word is being written into the RAMs is also the same. The only difference during time intervals 5, 6, 7 and 8 is that all of the information being read into the RAMs is valid (i.e., there are no junk bits).

This sequence of operations is repeated for each successive four time intervals until all of the information for all four bitmaps has been read into the video RAMs. As was indicated previously, this reading in operation can occur at the same time that information is being read out, since the video RAMs are dual ported, but is usually done during the relatively long time periods during which the video RAMs are not being read out. Once the video RAMs have been initially loaded, the information stored for any of the bitmaps may be updated at any time asynchronously without completely rewriting the bitmap.

From FIG. 4 it is seen that information for a given bitmap is stored in all four of the video RAMs 20 with the information for the bitmaps being interspersed in the memory. It is also noted that a given group is stored in a different RAM for each of the bitmaps. Thus, for example, group 4 is stored in video RAM 1 for bitmap 0, in video RAM 2 for bitmap 1, in video RAM 3 for bitmap 2, and in video RAM 4 for bitmap 3. Similarly, group 3 is stored in video RAM 1 for bitmap 1, in video RAM 2 for bitmap 2, in video RAM 3 for bitmap 3, and in video RAM 4 for bitmap 0. The reason for this arrangement will be apparent shortly.

Figure 5A:
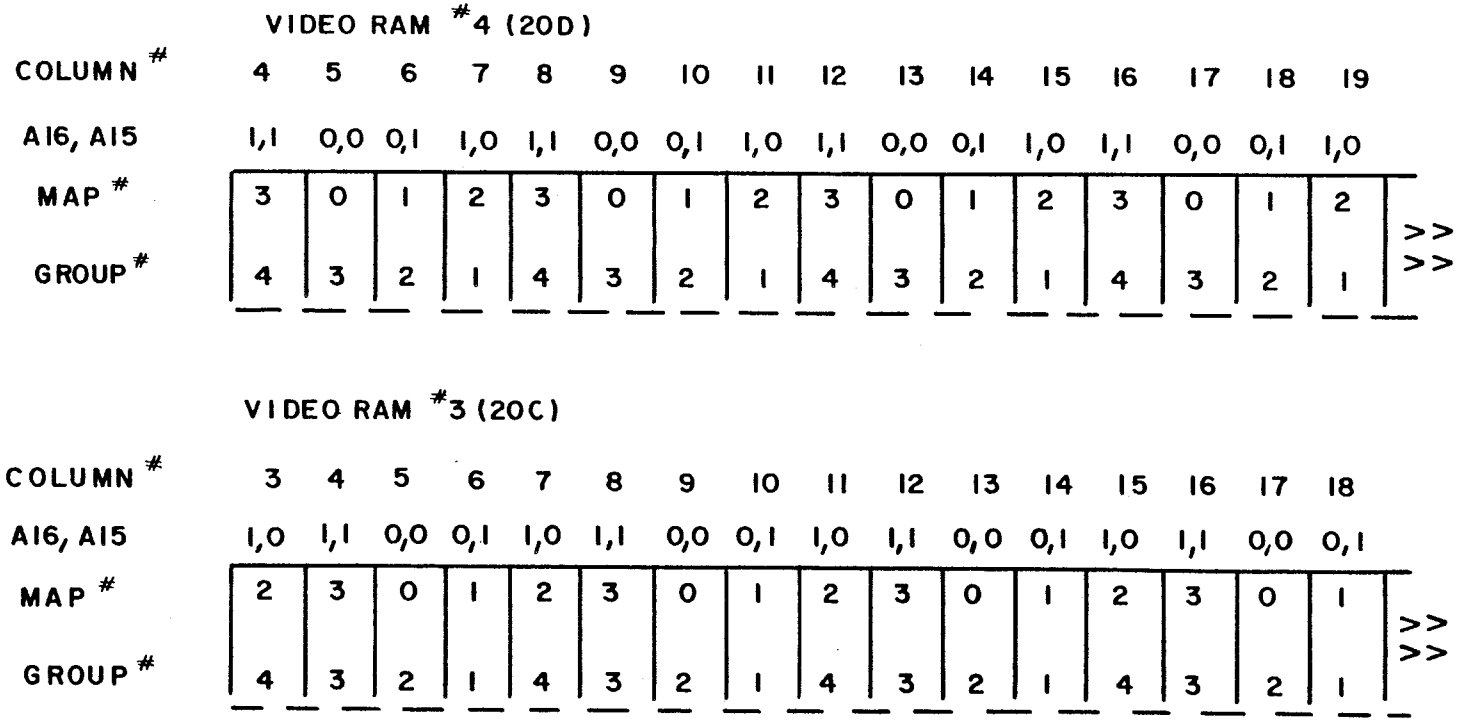
FIG. 5 is a diagram illustrating the manner in which bitmap information is read out from the video RAMs of FIG. 2.
Figure 5B:
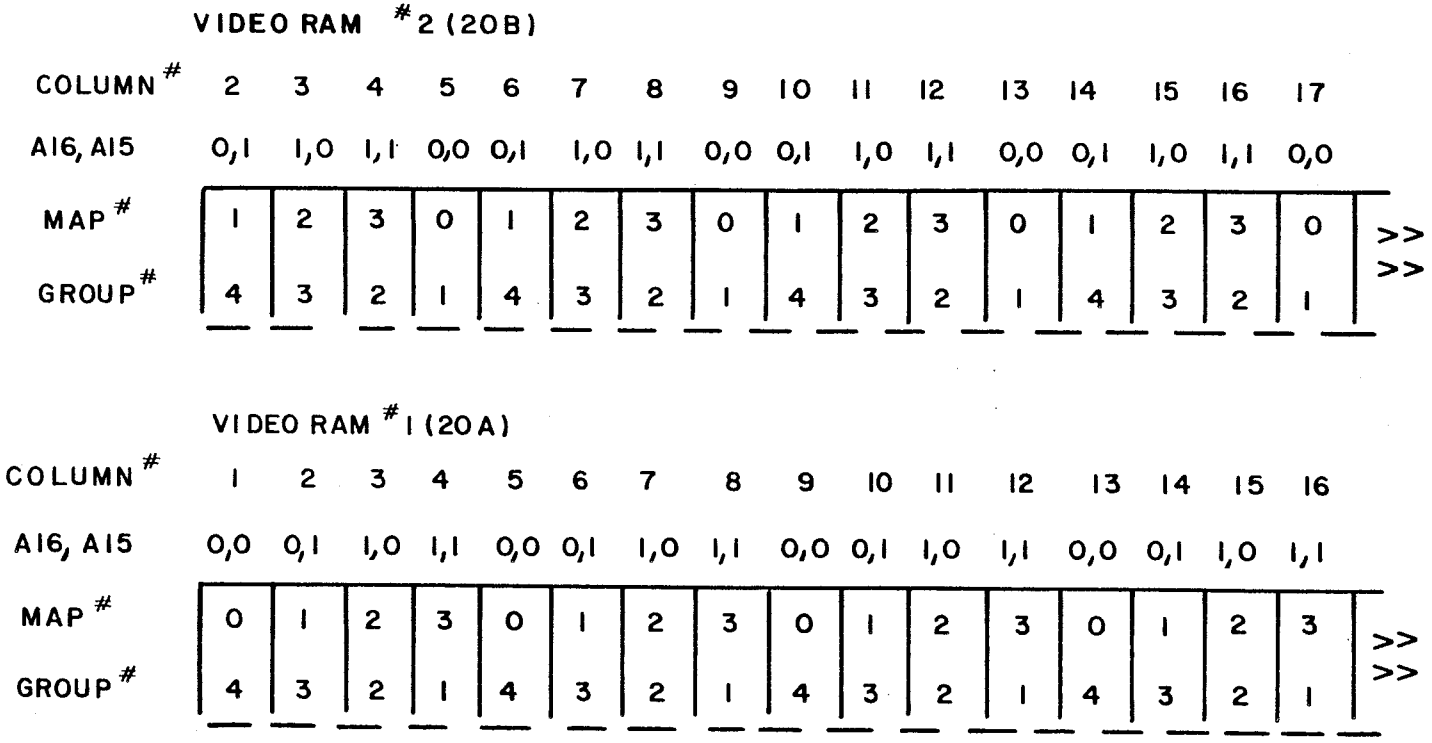

Refresh of the display on display 10 is controlled by the video state controller 32 which causes address inputs to be applied to read out information from the video RAMs at a pixel clock rate. For read out, the six bit VCS addresses on line 30 are the same as for read in. However, the two bits for each of the video RAMs outputted from address shifter 36 are shifted by the programmed logic of the programmed array as illustrated in FIG. 5. Thus, whereas on read in, during time period or column 1, bits 15 and 16 were both 0s for all three video RAMs, for read out these address bits have been shifted one position for video RAM 2, two positions for video RAM 3, and three positions for video RAM 4. The effect of this is to cause the group 4 nibble for all four bitmaps to be simultaneously read out from the video RAMs. Similarly, during the next clock time, the effect of the shifting is to cause the group 3 nibble for all of the bitmaps to be read out, and during the next clock time, the group 2 nibble for each of the bitmaps. During the fourth clock time, the group 1 nibble for each of the bitmaps is read out and the sequence is then repeated until the read out of the bitmaps has been completed.

Each nibble read out from a video RAM is stored in four bit multiplexer 44 and is then stepped out one bit at a time into multiplexer 50 under control of clock signals on lines 46 and 48. The clock signal on line 46 may for example have half the clock rate of the pixel clock and the clock signal on line 48 one quarter the clock rate of the pixel clock. These two clock signals are illustrated for example on lines A and B of FIG. 6. The multiplexer circuitry recognizes each combination of these two clocks as a particular clock time, as for example indicated on line C of FIG. 6, and causes a particular one of the stored nibble bits to be read out from the corresponding position of each of the four multiplexers during such clock time.

The four bits read out from the multiplexers at each clock time are applied through lines R1, R2, R3 and R4 to prioritizer 50. As previously indicated, prioritizer 50 may be a programmed array which is suitably programmed. Clock signals on lines 52 and 54 are also applied to prioritizer 50 during each clock time to permit the prioritizer to recognize the bitmap which each inputted bit corresponds to. This is necessary, referring to FIG. 5, since the bitmap which a nibble resident in a given RAM relates to is different for each column or clock time. One of the clocks would be at the nibble clock rate while the other clock is at twice this rate so that, for each successive four nibbles, the clocks present a different combination as for example shown in FIG. 6. Thus, prioritizer 50 will generate an output on a line 58 indicating that for the given pixel, information or display corresponding to the bitmap shown in the following Table I has priority:

TABLE I

Figure 6:
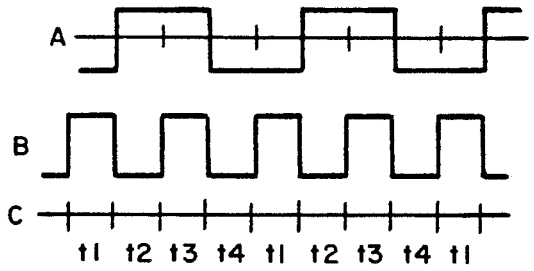
FIG. 6 is a diagram illustrating various timing signals used in the operation of the circuit of FIG. 2.

| | |
|---|---|
| Bitmap 0 | T1*R1 |
| | T2*R4 |
| | T3*R3 |
| | T4*R2 |
| Bitmap 2 | T1*R3*/R1 |
| | T2*R2*/R4 |
| | T3*R1*/R3 |
| | T4*R4*/R2 |
| Bitmap 3 | T1*R4*/R1*/R3 |
| | T2*R3*/R4*/R2 |
| | T3*R2*/R3*/R1 |
| | T4*R1*/R2*/R4 |
| Bitmap 4 | T1*R2*/R1*/R3*/R4 |
| | T2*R1*/R4*/R2*/R3 |
| | T3*R4*/R3*/R1*/R2 |
| | T4*R3*/R2*/R4*/R1 |

Where T1–T4 are the four time intervals indicated in FIG. 6;

R1–R4 are the output lines from the multiplexers for RAM 1 –RAM 4 respectively;

/RN means that RN is not present; and

* indicates a logical AND function.

A circuit which is adapted to prioritize bitmaps is thus provided, which circuit is rapid, low-cost and has a minimum parts count. While specific components such as video RAMs and programmed arrays have been disclosed as performing various functions for the preferred embodiment of the invention, it is apparent that other elements adapted to perform these functions might also be utilized. Further, while a particular number of address bits, particular word and nibble sizes and a particular number of bitmaps have been disclosed for the preferred embodiment, such numbers are for purposes of illustration only and are by no means a limitation on the invention. Thus, the invention could be practiced having a greater or lesser number of priority levels and thus a greater and a lesser number of bitmaps. This would result in corresponding changes in the number of multiplexers, in the addressing schemes and in the prioritizer, all of which change would be within the skill of one skilled in the art.

Thus, while the invention has been particularly shown and described above with reference to a preferred embodiment, the foregoing and other changes in form and detail may be made therein by one skilled in the art without departing from the spirit and scope of the invention.

What is claimed is:

1. In a video display system adapted to display on a video monitor having a plurality of display pixels a plurality of different types of information, each having a selected priority, means for controlling the type of information displayed at each display pixel comprising:

a number of video RAMs which is at least equal to the number of said different types of information;

means for storing a bitmap for each of said information types in said RAMs in interspersed fashion, a selected number of bits for selected display pixels of the bitmap for a given type of information being simultaneously stored in said RAMs followed for each RAM by the selected number of bits for the same selected display pixels for the bitmap of at least one other information type, no more than one bitmap bit for a given display pixel being stored in any video RAM;

means operative for shifting the addressing of said RAMs for read out of the bitmaps so that bits for the same display pixels of all the bitmaps are simultaneously readout from said RAMs; and prioritizer means responsive to the bits of the bitmaps for each display pixel for determining and generating an indication of the type of information which has priority and is to be displayed at the display pixel.

2. A means as claimed in claim 1 including multiplexing means for storing the number of bits read out for each bitmap read out from said RAMs and for applying said bits to said prioritizer means one bit from each bitmap at a time.

3. A means as claimed in claim 2 wherein the number of bits read out for each bitmap read out is said selected number.

4. A means as claimed in claim 2 wherein said prioritizer means includes means for recognizing the bitmap which each set of bits from the RAMs relate to.

5. A means as claimed in claim 4 wherein said means for recognizing includes means for generating timing signals, and means responsive to the state of the timing signals for indicating the bitmap to which a bit received from a given RAM relates.

6. A means as claimed in claim 1 wherein said prioritizer means is adapted to grant priority for a given display pixel to the highest priority information type which has a bit corresponding to said display pixel in its bitmap.

7. In a video display system adapted to display on a video monitor having a plurality of display pixels a plurality of different types of information, each having a selected priority, a method for controlling the type of information displayed at each display pixel comprising the steps of:

providing a number of video RAMs which is at least equal to the number of said different types of information;

storing a bitmap for each of said information types in said RAMs in interspersed fashion, a selected number of bits for selected display pixels of the bitmap for a given type of information being simultaneously stored in said RAMs followed for each RAM by the selected number of bits for the same selected display pixels for the bitmap of at least one other information type, no more than one bitmap bit for a given display pixel being stored in any video RAM;

shifting the addressing of said RAMs for read out of the bitmaps so that bits for the same display pixels of all the bitmaps are simultaneously read out from said RAMs; and prioritizing the bits of the bitmaps for each display pixel, the prioritizing step including the steps of determining and generating an indication of the type of information which has priority and is to be displayed at the display pixel.

8. A method as claimed in claim 7 including the steps of storing the number of bits read out for each bitmap read out from said RAMs, and applying said bits to said prioritizer means one bit from each bitmap at a time.

9. A method as claimed in claim 8 wherein the number of bits read out for each bitmap readout is said selected number.

10. A method as claimed in claim 8 wherein said prioritizing step includes the step of recognizing the bitmap which each set of bits from the RAMs relate to.

11. A method as claimed in claim 10 wherein said recognizing step includes the steps of generating timing signals, and indicating, in response to the state of the timing signals, the bitmap to which a bit received from a given RAM relates.

12. A method as claimed in claim 7 wherein said prioritizing step is adapted to grant priority for a given display pixel to the highest priority information type which has a bit corresponding to said display pixel in its bitmap.

* * * * *